US006234827B1

(12) United States Patent
Nishio et al.

(10) Patent No.: US 6,234,827 B1
(45) Date of Patent: May 22, 2001

(54) ELECTRICAL CONNECTOR SHIELD WITH DUAL FUNCTION OF MECHANICAL LOCKING AND ELECTRICAL SHIELDING CONTINUETY

(75) Inventors: Atsushi Nishio, Nishiibaraki-gun; Katsuhiro Hori, Mito, both of (JP)

(73) Assignee: Mitsumi Newtech Co., Ltd. (JP)

( * ) Notice: Subject to any disclaimer, the term of this patent is extended or adjusted under 35 U.S.C. 154(b) by 0 days.

(21) Appl. No.: 09/491,753

(22) Filed: Jan. 27, 2000

(30) Foreign Application Priority Data

Jan. 27, 1999 (JP) ..... 11-018580

(51) Int. Cl.[7] ..... H01R 13/627
(52) U.S. Cl. ..... 439/357
(58) Field of Search ..... 439/357, 350, 439/351, 352, 353, 354, 355, 356, 345, 607

(56) References Cited

U.S. PATENT DOCUMENTS 5,127,847 * 7/1992 Kato et al. ..... 439/357

* cited by examiner

*Primary Examiner*—Brian Sircus
*Assistant Examiner*—Javaid Nasri
(74) *Attorney, Agent, or Firm*—Morrison Law Firm

(57) ABSTRACT

A "small" or "miniature connector comprises: a connector socket 2, having a shield case 4, which is a metal plate bent and formed into a rectangular tube, and an insulating housing 6, which supports a plurality of contact pins 5 and is built into the interior of shield case 4; a connector plug 3, having a plug part 3*a* which is inserted into an insertion opening 11 of connector socket 2; a contact member 26, which has a shallow "V" shaped cross-section and is flexible, being formed by cutting out and offsetting on a top wall of shield case 4; and a protrusion 27 of inverted "V" shape, which engages with contact member 26, being placed on an upper surface of plug part 3*a*.

2 Claims, 5 Drawing Sheets

ELECTRICAL CONNECTOR SHIELD WITH DUAL FUNCTION OF MECHANICAL LOCKING AND ELECTRICAL SHIELDING CONTINUETY

BACKGROUND TO THE PRESENT INVENTION

The present invention relates to an electrical connector. In particular, the present invention relates to a connector used in connecting electronic devices such as personal computers and the like.

In recent years, connectors termed universal serial bus (USB) connectors as shown in FIG. 5 have been used in computers. Because of component crowding in small space areas in computers and like devices, the connectors used are sometimes referred to as "small" or "miniature" connectors.

This connector comprises a connector socket 2A, which can be mounted onto a substrate of a printed circuit board 1A and the like, and a connector plug 3A, which is inserted into and connects to connector socket 2A. Connector socket 2A is equipped with a shield case 4A, which is constructed by bending and shaping a metal plate into a tube of rectangular section.

An insulated housing 6A, which supports four contact pins 5A side by side in the cross direction, is built into the inside of shield case 4A. The middle section of contact pin 5A is attached to the base of insulated housing 6A. Contact pin 5A has an external connection end 5*a*, which leads out from one end of shield case 4A. An end support part 6*b* is formed integrally on the top half of base 6*a* of insulated housing 6A. End support part 6*b* has approximately half of the vertical thickness of shield case 4A. A contact end 5*b* of contact pin 5A is supported by the lower surface of end support part 6*b*.

Connector plug 3A, which connects to connector socket 2A, also has a shield case 7A, which is a tube of rectangular section. Shield case 7A is insertable inside shield case 4A. A cavity 8A, which receives end support part 6*b*, is formed in the interior of a plug shield 7*a* of shield case 7A. A contact end 10*a* of a contacter 10A, which is supported by an end support part 9*a* of an insulated housing 9A, is positioned directly below cavity 8A.

However, in the "small" connector of the prior art as described above, a pair of locking tabs 11A, 11B are formed by cutting out and offsetting locking tab structure from both the top wall and bottom walls of shield case 4A. On the top wall and bottom wall of plug shield 7*a*, there are locking slots 12A, 12B, corresponding to locking tabs 11A, 11B. Connector plug 3A is locked into connector socket 2A by dropping locking tabs 11A, 11B into corresponding locking slots 12A, 12B. Furthermore, in this connector, in order to protect the interior of connector socket 2A and connector plug 3A from the effects of external magnetic fields and external electric fields, there are contact pieces 13A which are cut out and offset on the right and left side walls of connector socket 2A. The ends of contact pieces 13A are pressed against and contact the surface of the corresponding side walls of shield case 7A, and there is grounding between shield case 4A and shield case 7A.

In other words, in the connector described above, four locking tabs 11A, 11B and two contact pieces 13A are bent and shaped on the perimeter walls of shield case 4A of connector socket 2A. Locking tabs 11A, 11B and contact pieces 13A become a hindrance, and there is a limit to the degree of miniaturization possible with the connector.

OBJECT AND SUMMARY OF THE PRESENT INVENTION

The above problems of the prior art were considered. The object of the present invention is to obtain a construction for locking a connector plug to a connector socket by a relatively simple construction that is capable of miniaturization and that can reliably shield external magnetic fields and the like.

In order to achieve this objective, the present invention is a connector, comprising: a connector socket, having a shield case, which is a metal plate bent and formed into a tube of rectangular cross section, and an insulating housing, which supports a plurality of contact pins and is built into the interior of the shield case; a connector plug, having a plug part which is inserted into an insertion opening of the connector socket; an elongated contact member, a fore length of which has a longitudinal cross-section of shallow "V" shape; this contact member being formed by cutting out and offsetting a part of a top wall of the shield case; a protrusion which is engagable with the contact member to effect locking of the connector plug to the connector socket, the protrusion being provided on an upper surface of the plug part.

In the description of the preferred embodiment to follow, it will be understood that the protrusion can be a bead or it can be an element bent out of the plug shield, which plug shield is a metal plate that itself is bent and processed into a rectangular cross section tube.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Referring to FIGS. 1 through 4, an embodiment of the present invention is described in detail.

Figure 1:
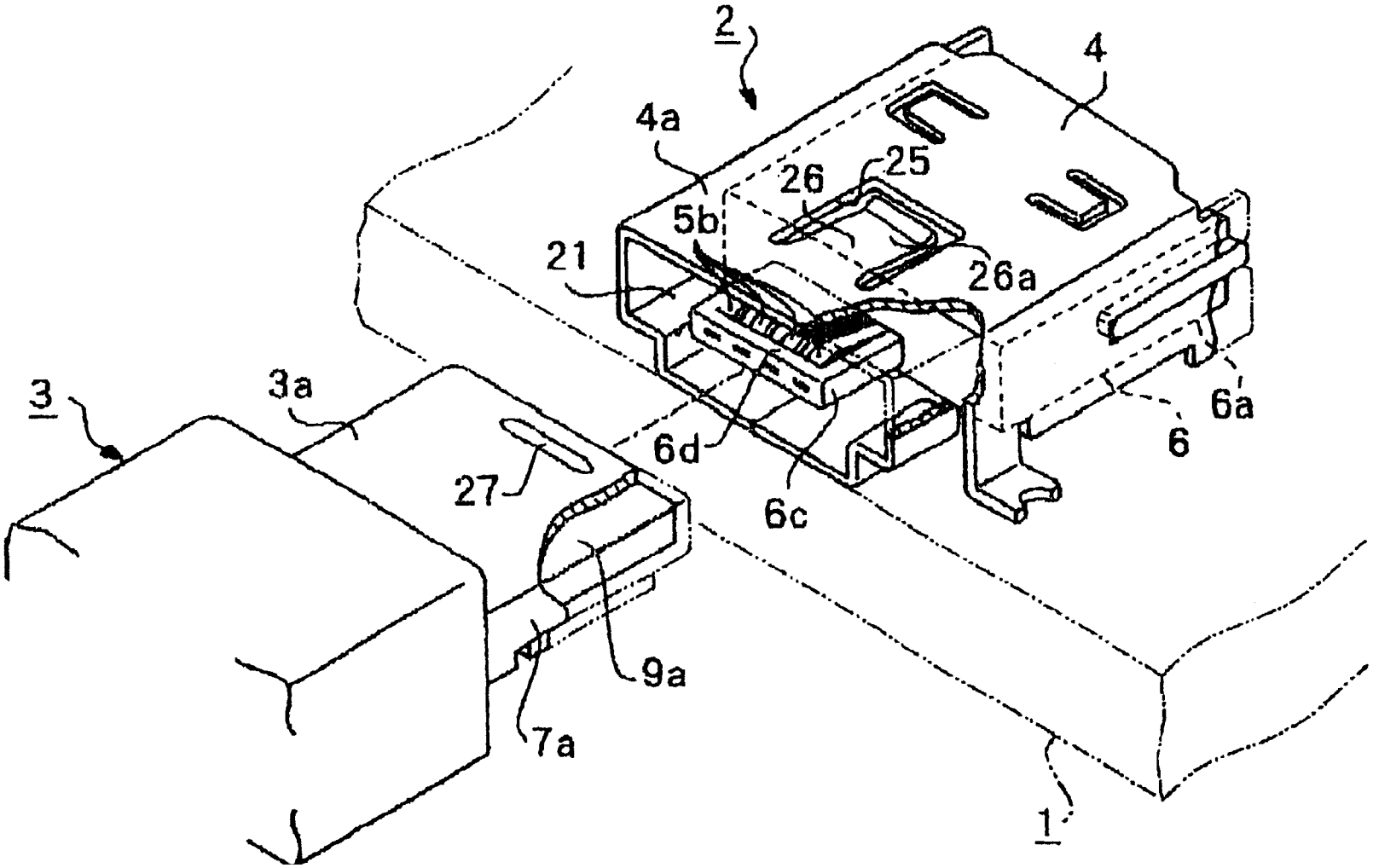
FIG. 1 is an exploded perspective drawing of the connector of the present invention with a section removed.
Figure 2:
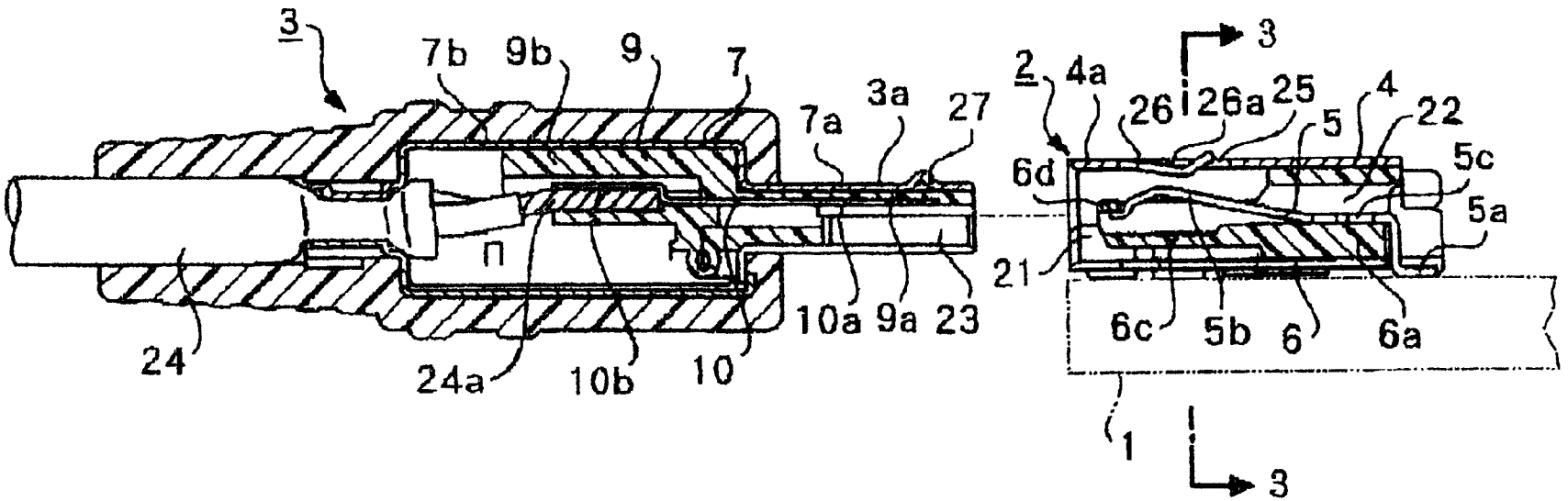
FIG. 2 is a longitudinal cross-section of the same connector, the connector plug not being inserted in the connector socket.
Figure 3:
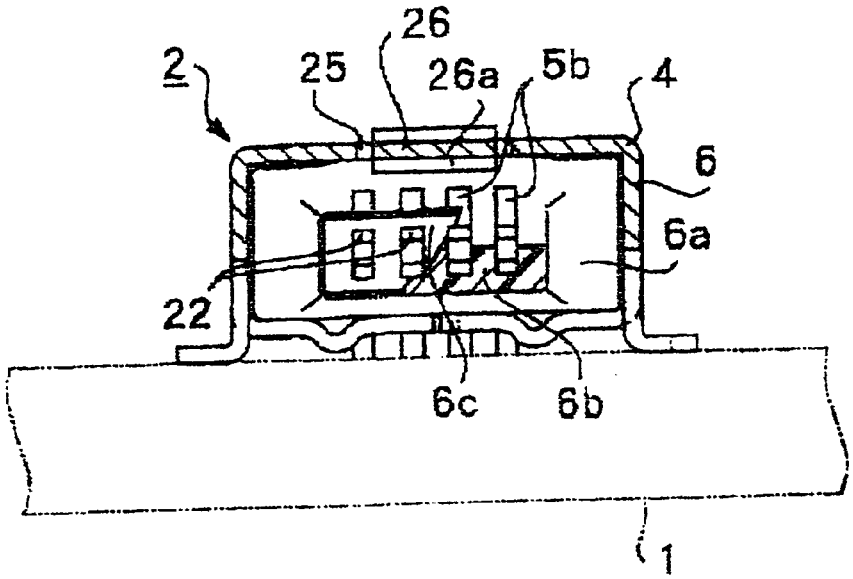
FIG. 3 is a view taken along line 3—3 of FIG. 2.
Figure 4:
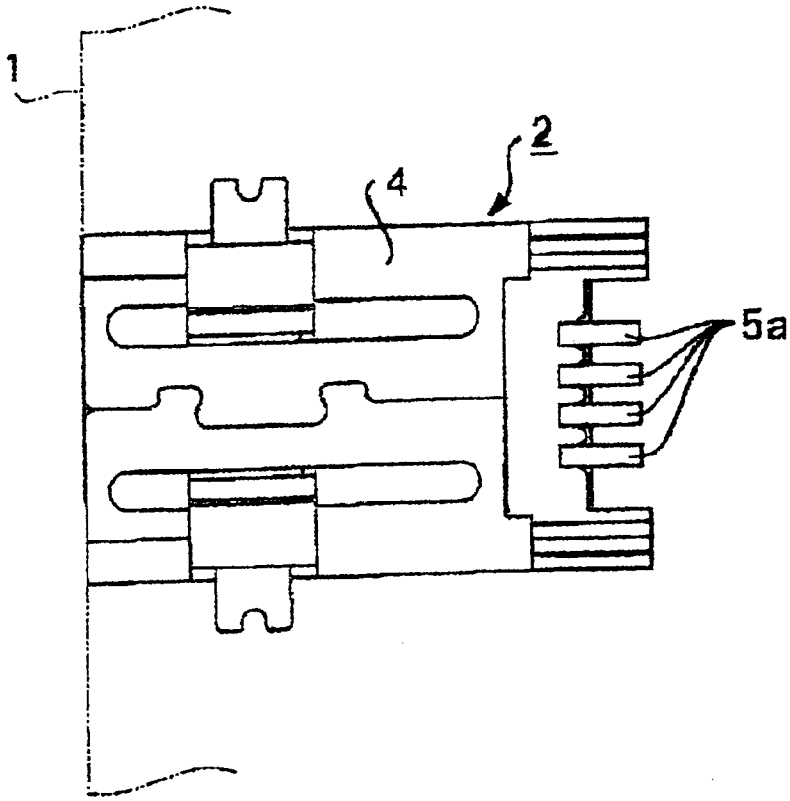
FIG. 4 is a bottom plan of the connector socket 2.
Figure 5:
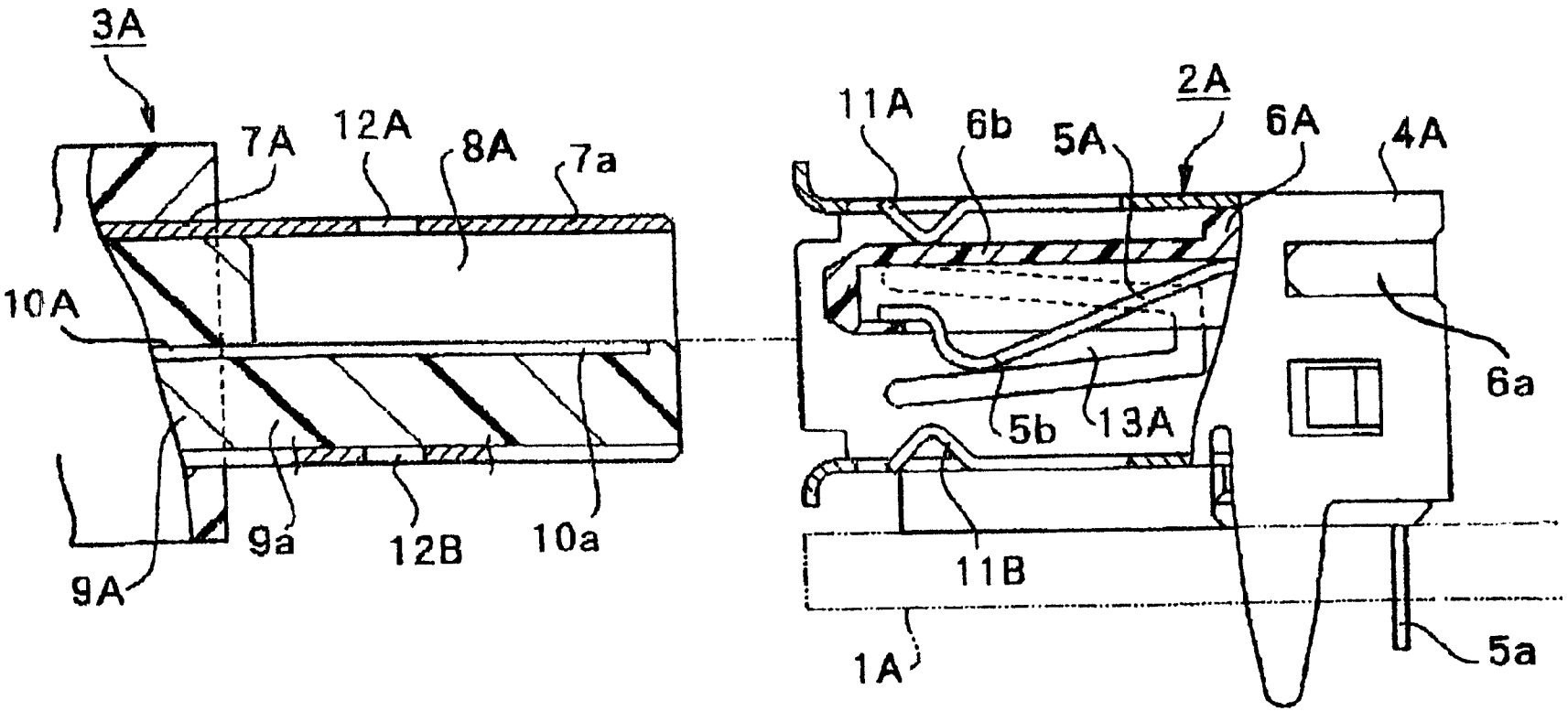
PRIOR ART Fig. 5
FIG. 5 is a longitudinal side view partly in section of a USB connector of the prior art.

A "small" connector of the present invention is shown in FIGS. 1 and 2. The small connector comprises a connector socket 2, which is mounted onto the surface of a printed circuit board 1, and a connector plug 3, which has a plug part 3*a* which can be inserted into an insertion opening 21 of connector socket 2.

Connector socket 2 has a shield case 4, which is a metal plate bent and deformed into a rectangular section tube so that one end thereof forms an insertion opening 21 for reception of plug part 3*a*. An insulated housing 6 of a molded resin is positioned inside shield case 4. Insulating housing 6 supports four contact pins 5 aligned in the cross direction of shield case 4.

Insulated housing 6 is built into shield case 4 from the right end of shield case 4. Insulated housing 6 has a base 6*a*, which has approximately the same cross-sectional dimensions as the inner cross sectional area of shield case 4. Inside shield case 4, there is an integrally formed end support part 6*c* which extends as a cantilever on the left side of base 6*a*.

Inside insulated housing 6, four attachment grooves 22, which are aligned in parallel in the cross direction of shield case 4, are formed in the longitudinal direction of shield case 4. Each of contact pins 5, which are made of spring-like metal, is positioned in each of attachment grooves 22. The mid-section of each contact pin 5 is attached inside corresponding attachment groove 22. However, external contact end 5*a*, which is bent and processed into an "L" shape, leads out to the exterior from the right end of shield case 4. External contact end Sa is soldered onto the conductor layer of printed circuit board 1 on which connector socket 2 is mounted.

From attachment groove 22, which is open above, curved contact end 5*b* of each contact pin 5 extends along and opposed to the upper surface of end support part 6*c*. However, the end of contact end 5*b* engages with engaging part 6*d*, which is formed integrally on the end of end support part 6*c*. By this engagement, the unrestrained releasing of external contact end 5*a* from corresponding attachment groove 22 is controlled.

Connector plug 3, which is covered by an external covering of an insulated resin, is equipped with a plug part 3*a*, which can be inserted into insertion opening 21. Plug part 3*a* has a plug shield 7*a* of shield case 7. Plug shield 7*a* has outer shape dimensions that correspond to the inner dimensions of shield case 4 of connector socket 2. As in shield case 4, plug shield 7*a* is constructed by bending and deforming a metal plate into a rectangular tube. End support part 9*a* of insulated housing 9 supports four contacters 10, which have a corresponding relation with contact pins 5, and are positioned inside of plug shield 7*a*.

Contact ends 10*a* of each of contacters 10 are exposed at the lower surface of end support part 9*a* of insulated housing 9, which extends along the top wall of plug shield 7*a*. A cavity 23 for receiving end support part 6*b* of insulated housing 6 is formed between the lower surface of end support part 9*a* and the upper surface of the bottom wall of plug shield 7*a*.

When plug part 3*a* of connector plug 3 is inserted into insertion opening 21 of connector socket 2, end support part 6*b* of insulated housing 6 and end support 9*a* of insulated housing 9 become proximate and are opposite each other in the vertical direction. As a result, contact end 10*a* of each of contacters 10 comes in contact with contact end 5*b* of the corresponding contact pin 5.

Shield case 7 has a cord shield 7*b*, which is formed integrally with plug shield 7*a* and has a large volume. A cord connecting part 9*b*, which is connected to end support part 9*a*, is positioned inside cord shield 7*b*. Cord connecting end 10*b* of each of contacters 10 is positioned at cord connecting part 9*b*. Cord connecting end 10*b* is each attached by soldering to core 24*a* of connecting cord 24, which leads out from the end of cord shield 7*b*.

In the present invention, on the top wall of shield case 4 of connector socket 2, a C-shaped cutting and offsetting groove 25 defines a flexible tongue-like contact member 26. The contact member has a fore part 26*a* which presents a longitudinal sectional shape of a shallow "V". Contact member 26 has its base or rear part cantilever supported from top wall 4*a* of shield case 4. On the upper surface of plug shield 7*a*, a protrusion 27, is bent and formed out of the plug shield structure. The configuration of the protrusion is complementally matching with that of the bent fore part 26*a* of contact member 26. Protrusion 27 is of an inverted "V" cross section. The length of protrusion 27 is the same approximate width as contact member 26.

Protrusion 27, which is formed during the bending processing of shield case 7, resiliently contacts bent part 26*a* of contact member 26. Shielding occurs through the conducting of shield case 4 and shield case 7 via protrusion 27 and contact member 26.

Figure 6B:
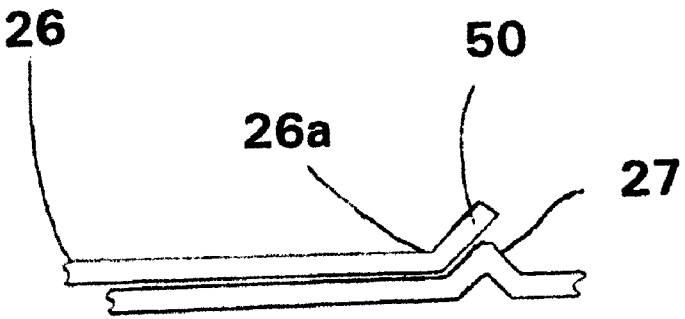
FIGS. 6(*a*) and 6(*b*) are respective schematic depictions of the manner in which the connector plug carried protrusion engages the connector socket contact member during plug insertion in the socket to deflect it and pass beyond said contact member so as to lockingly engage behind the contact member on completion of socket plug insertion in the socket.
Figure 6A:
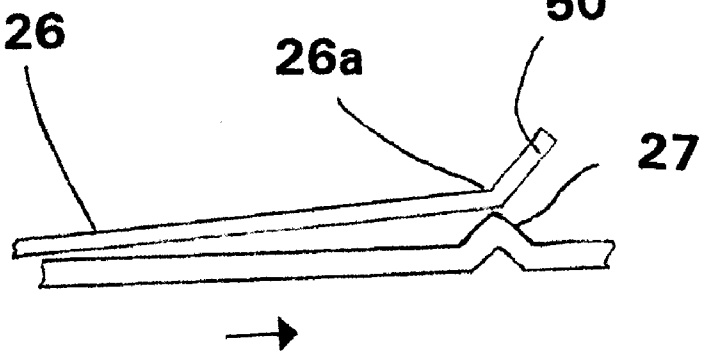

When inserting plug part 3*a* of connector plug 3 into insertion opening 21 of connector socket 2, when it is inserted nearly completely, bent part 26*a* of contact member 26 is deflected upwardly and rides over bead protrusion 27 as depicted in FIG. 6(*a*). As a result, because of the complemental "V" and inverted "V" configuration relation between protrusion 27 and contact member 26 and the release of deflection force on the bent part 26*a*, protrusion 27 becomes seated behind the tip end leg 50 of bent part 26*a* as seen in FIG. 6(*b*) to effect a locking condition between connector socket 2 and connector plug 3 to inhibit accidental separation of the connector plug from the connector socket. This locking condition is such as to prevent withdrawal of the connector plug from the socket except upon deliberate application of a separation force to effect same.

Protrusion 27 can be formed at the same time as the process of bending and forming shield case 7. As a result, production cost can be lessened.

As is clear from the description above, by the present invention, a contact member with a shallow "V" shaped cross section is cut out and offset and formed in the top wall of a shield case of a connector socket. By contacting the bent part of this contact member with a protrusion of a connector plug, shielding occurs due to conducting of the shield case by the contact member and the protrusion, and locking of the connector plug with respect to the connector socket occurs.

Having described preferred embodiments of the present invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrical connector comprising:

a connector socket including a metal shield case of rectangular tubular cross section;

an insulated housing disposed in said shield case;

said insulated housing supporting a plurality of contact pins;

a connector plug;

said connector plug including a plug part insertable in an opening in said connector socket;

said plug part including a metallic plug shield on a surface thereof;

a wall part of said metal shield case being slit to form an elongated flexibly mounted metallic contact member resiliently connected at a first end to said metal shield case, and resiliently free to be displaced at its second end;

a fore end part of said metallic contact member having a longitudinal sectional configuration of a V shape;

an outward protrusion integrally formed on said metallic plug shield;

said protrusion having a shape complementary to said V shape, and being positioned so that said fore end is urged upward by said protrusion during insertion of said connector plug into said connector socket to ride up over said protrusion during insertion of said connector plug into said connector socket, and to be restored downward by springback of said metallic contact member into retaining contact past said protrusion, whereby said connector plug is retained fully inserted in said connector socket; and electrical contact between said protrusion and said metallic contact member providing shielding continuity between said metallic plug shield and said metal shield case, whereby the dual function of mechanical locking and electrical shielding continuity is accomplished.

2. An electrical connector according to claim 1, wherein said retaining contact requires substantially more force to disengage than a force required to engage, whereby when said connector plug is retained in said connector socket, substantially more force is required for disengagement than is required for engagement.

* * * * *